US005903934A

United States Patent [19]

Sears, III

[11] Patent Number: 5,903,934

[45] Date of Patent: May 18, 1999

[54] SANITARY FIXTURES FOR USE WITH A MOBILE PATIENT LIFT

[76] Inventor: Leonard W. Sears, III, 6924 Harpeth Glen Trace, Nashville, Tenn. 37221

[21] Appl. No.: 08/734,229

[22] Filed: Oct. 21, 1996

[51] Int. Cl.[6] ..... A47K 3/02

[52] U.S. Cl. ..... 4/538; 4/546; 4/559

[58] Field of Search ..... 4/538, 546, 559, 4/560.1, 561.1, 562.1, 563.1, 564.1, 584, 592

[56] References Cited

U.S. PATENT DOCUMENTS

| | | | |
|---|---|---|---|
| D. 95,375 | 4/1935 | Morgan . | |
| D. 267,033 | 11/1982 | Koet . | |
| D. 321,556 | 11/1991 | Reid et al. . | |
| 1,738,256 | 12/1929 | Miller | 4/538 |
| 1,849,346 | 3/1932 | Cromwell . | |
| 2,074,234 | 3/1937 | Mueller . | |
| 2,102,733 | 12/1937 | Mueller . | |
| 2,841,795 | 7/1958 | Pelicano | 4/592 |
| 3,233,857 | 2/1966 | Schuck | 4/538 |
| 3,457,569 | 7/1969 | Von Ardenne et al. . | |
| 3,889,304 | 6/1975 | Loren . | |
| 4,211,216 | 7/1980 | Burgess et al. . | |
| 4,664,982 | 5/1987 | Genovese et al. . | |
| 4,706,311 | 11/1987 | Jarosinski . | |
| 4,844,944 | 7/1989 | Grafe et al. . | |
| 4,844,955 | 7/1989 | Graefe et al. . | |
| 5,098,629 | 3/1992 | Marsilio . | |
| 5,129,804 | 7/1992 | Perantoni et al. . | |
| 5,338,501 | 8/1994 | Marsilio . | |
| 5,341,527 | 8/1994 | Schmidt et al. . | |
| 5,343,575 | 9/1994 | Cartwright . | |

FOREIGN PATENT DOCUMENTS

| | | |
|---|---|---|
| 2 293 321 | 3/1996 | United Kingdom . |
| WO 86/05673 | 10/1986 | WIPO . |

OTHER PUBLICATIONS

Arjo Hospital Equipment AB (Sweden) "Fixed Height Bathing System" (product brochure), printed in USA –No Date.

Integrity Whirlpool Products, North Little Rock, Arkansas, "Building with Integrity(R)" (product brochure) –No Date.

Barrier Free Lifts(R) Inc., Manassas, Virginia, "The Original Diana Lift" (product brochure) –No Date.

*Primary Examiner*—David J. Walczak

[57] ABSTRACT

A bathtub of integral construction especially adapted for installation in a private residence has a sump bottom spaced a sufficient distance above the floor and an opening in the apron leading to the space beneath the sump. The sump bottom spacing and apron opening enable the positioning of a portion of the undercarriage of a mobile patient lift underneath the sump bottom so that the bather supported by the lift can be positioned directly above the sump. Accordingly, the bather, who may be an invalid or other seriously physically handicapped person, may be transferred to a residential style bathtub in his home without having to disembark the lift. The invention also includes methods of making the bathtubs and using them with the mobile patient lifts.

20 Claims, 6 Drawing Sheets

SANITARY FIXTURES FOR USE WITH A MOBILE PATIENT LIFT

BACKGROUND OF THE INVENTION

1. Field of the Invention

This invention relates to sanitary fixtures. Specifically, it relates to bathtubs and whirlpool type bathtubs of integral construction especially adapted for use in combination with a mobile patient lift by invalids or other physically handicapped persons.

2. Description of Related Art

Personal hygiene and hydrotherapy are important to the general health and recovery of invalids, other seriously physically handicapped patients, and generally physically weak or frail persons. Health care workers, such as nurses, hospital aides, nursing home staff, or home health aides, assist in transferring these patients from their beds to the bathtub or whirlpool using a mobile patient lift. Patient lifts and bathtubs have been designed so that it is unnecessary for the patient to disembark the lift before getting into the bathtub. The Arjo fixed height bathtub and Lift Hygiene Chair mobile patient lift is one example of a system that can be used in this manner. Both devices are available from Arjo Hospital Equipment AB of Sweden or Arjo Inc. of Morton Grove, Ill. Such bathtub/lift systems can reduce the risk that the patient will slip or fall during the transfer. They also reduce the risk of lower back injury or other serious occupational injury to the health care worker.

The Arjo mobile patient lift and bathtub are used in the following manner. The patient is placed on the chair-like patient support of the lift and wheeled to the side rather than the end of the bathtub. The patient sits sideways in the patient support so that he is facing an end of the bathtub, such as the drain end. The lift mechanism is actuated to raise the patient above the side wall of the bathtub. Once the side wall has been cleared, the lift is placed closer to the bathtub so that a portion of the lift's mobile undercarriage is positioned directly beneath the sump and the patient is directly above the sump.

This positioning is possible because the sump of the Arjo fixed height bathtub does not rest on the floor like a conventional residential style bathtub. Instead, the sump is supported from below by sturdy, exposed horizontal support beams and vertical posts. The horizontal beams are elevated a sufficient distance above the floor so that the support legs and front wheels of the undercarriage portion of the lift can easily be positioned below the sump. Once positioned above the sump, the patient and support are then together lowered into the sump. Following the bath or hydrotherapy, the process is reversed to return the patient to bed.

Delivery of health care in a hospital, nursing home, or other institutional setting is very expensive compared to recuperation or therapy at home. There is a continuing effort to reduce health care costs by discharging patients from the hospital to their homes as soon as possible. For those invalids who can otherwise be cared for at home rather than in a hospital or other institution, bathing and/or hydrotherapy present a serious impediment to health care cost reduction: Most residential bathrooms are either too small to accommodate the bathtubs adapted for use with a mobile patient lift or patients are reluctant to abandon their stylish, colorful, and aesthetically pleasing residential style bathtubs for a more expensive bathtub having an institutional appearance. These residential style bathtubs and whirlpool type bathtubs do not accommodate the positioning of the undercarriage of the lift underneath the sump bottom so that the patient can be positioned above the sump.

The prior art describes various solutions to the problem of transferring an invalid into a bathtub or whirlpool, but none is directed to a residential rather than institutional style bathtub especially adapted for use with a mobile patient lift in a typical residential bathroom of limited size.

U.S. Pat. No. 3,457,569 to Von Ardenne et al., "Lifting Device for Lifting a Patient Treated in a Bathtub," describes a front-loading lift with a mobile undercarriage adapted to fit under the end, rather than the side, of a tub. Such an arrangement would require a very wide bathroom. Furthermore, the bathtub is not adapted for use of a side-loading lift such as the Arjo lift describe above.

U.S. Pat. No. 3,889,304 to Loren, "Bathing Device for Invalided Person" describes a patient lift and an institutional style bathtub. The patient lift is not mobile. Instead, it is attached to the bathtub.

U.S. Pat. No. 4,211,216 to Burgess et al., "Whirlpool Bath," describes raising a whirlpool bathtub above the floor level onto a recessed steel base. The 8¾ in. vertical clearance provided by the base provides a channel beneath the tub on three sides allowing a front-loading type mobile lift to be moved directly underneath the end rather than the side of the tub. Accordingly, as with the Von Ardenne invention, the bathroom must be quite large to accommodate positioning the large front-loading type mobile lift adjacent the end of the bathtub. The entire tub structure rests on the base by means of a plurality of I-beams which traverse the narrower dimension of the base. The Burgess invention is specifically designed for use in the hospital or institutional setting. The Burgess whirlpool does not resemble a whirlpool that one would expect to be accepted in a residential environment in part because it rests on an elevated and recessed steel base rather than directly on the floor.

U.S. Pat. No. 5,338,501 to Marsilio describes a molded bathtub having an apron which terminates above, below, or at about the level of the lowest level of the reservoir or sump. U.S. Pat. No. 4,664,982 to Genovese et al., "Multi-Layer Composite Structure," shows an enameled-steel bathtub having an apron which terminates at a level below the lowest level of the sump, but the patent does not describe or suggest any benefit in having this configuration. It does not describe how far below the lowest level of the sump the apron should terminate.

U.S. Pat. No. 5,343,575 to Cartwright, "Portable Bathing Unit," describes a molded bathtub mounted on a portable frame having casters. Rather than transporting the bedridden patient to the bath, this patent describes bringing the portable bath to the vicinity of the patient. The patient is transferred to the bath using a mobile patient hoist. The casters elevate the bathtub's frame high enough above the floor to permit the legs of the mobile patient hoist to pass underneath. The patent notes that conventional bathtubs typically are not elevated and, hence, do not allow the legs of the patient hoist to pass underneath.

There continues to be a need for sanitary fixtures, e.g., bathtubs and whirlpools, that resemble conventional, floor mounted fixtures of integral construction which are adapted for use with a mobile patient lift in the bathroom of the patient's home.

SUMMARY OF THE INVENTION

The present invention provides a sanitary fixture, e.g., bathtub, of integral construction having a sump bottom and an apron. The apron has a floor edge surface which rests on the floor supporting the sanitary fixture in use. The sump bottom is spaced a sufficient distance above the floor to permit positioning the supporting legs and wheels of a mobile patient lift underneath the sump bottom. An appropriately sized opening in the apron adjacent the floor edge surface can be provided before or after installation of the fixture in a residential bathroom. The apron opening enables positioning a portion of the undercarriage of a mobile patient lift, e.g., the supporting legs and wheels, underneath the fixture. A closure, such as a removable panel or hinged door, may be provided to cover the apron opening when not occupied by the mobile patient lift. But for the somewhat higher apron height, optional apron opening 12, and the optional opening closure, the fixture of the present invention otherwise resembles a conventional residential style sanitary fixture of integral construction made from acrylic-coated fiberglass-reinforced plastic, gel-coated fiberglass-reinforced plastic, plastic-backed enameled steel, enameled steel, enameled cast iron, marble, composite, reinforced plastic, and other molded or non-molded materials.

Accordingly, the principal object of the invention is to provide a sanitary fixture which resembles a conventional residential bathtub, whirlpool type bathtub, or combination bathtub/shower unit popular in family residences, but which is compatible and especially adapted for use with a mobile patient lift by invalids or other persons in a residential bathroom.

Another object is to provide a fixture which accommodates positioning a bather supported by a mobile patient lift directly above the sump by positioning a portion of the lift undercarriage underneath the sump bottom.

In accordance with a second embodiment of the invention, another object is to provide a fixture of integral construction which can be installed first and thereafter easily modified by cutting out or otherwise removing a portion of the apron to accommodate positioning a portion of a mobile patient lift underneath the sump bottom.

Yet another object is to provide a method of making the fixtures of the instant invention and a method of using a mobile patient lift in combination with the fixtures of the instant invention.

These and other objects of the present invention will become readily apparent upon further review of the specification and drawings.

DESCRIPTION OF THE PREFERRED EMBODIMENTS

The term "sanitary fixture" as it is used in this specification means any container capable of containing a sufficient quantity of cleansing fluid, such as water, so that at least a portion, preferably a substantial portion, of a living organism or inanimate object, whether a person or animal and regardless of size or age, may be immersed in the cleansing fluid. The term includes, without limitation, bathtubs adapted for residential or institutional use, whirlpool type bathtubs, and bathing basins, whether or not equipped with openings for a drain, air and/or water jets, or similar plumbing connections. It also includes bathtub/shower combination units which may include the appropriate openings for faucet, water flow control levers or knobs, shower heads, and air and/or water jet nozzle openings in the case of a whirlpool type bathtub/shower combination unit. The term "sanitary fixture" includes such containers having an opening for draining the fluid whether or not equipped with drain stopper means for preventing drainage. Throughout this specification, the terms "sanitary fixtures" and "fixture" are used interchangeably. The bathtub version of the invention has been used to provide a detailed description of the invention, but the description is applicable to the other type of sanitary fixtures listed above which are intended to fall within the scope of the term "sanitary fixture" and "fixture."

Figure 1:
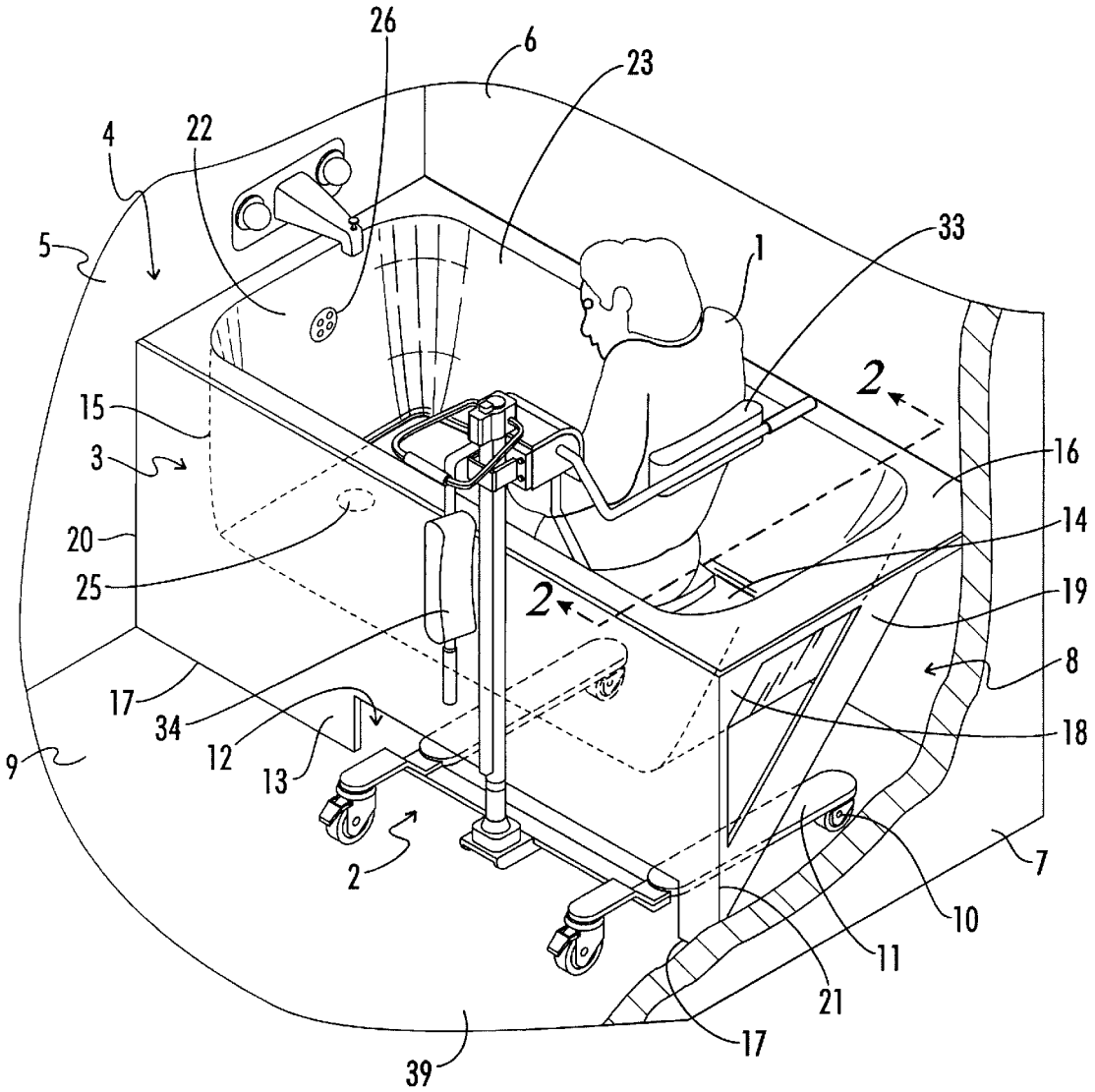
FIG. 1 is a perspective view of a bather using a bathtub of the instant invention while supported on a prior art mobile patient lift.
Figure 2:
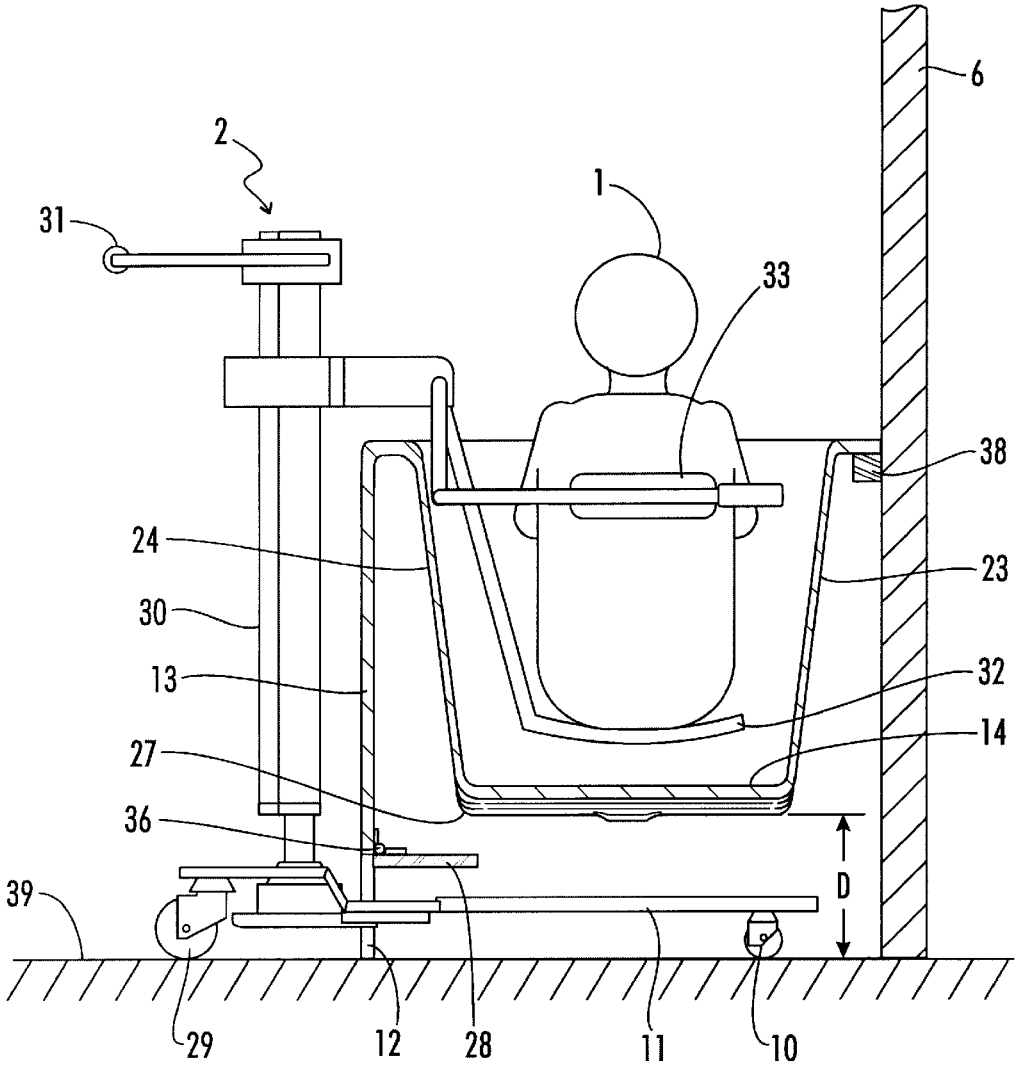
FIGS. 2 is an elevation view of the bather, bathtub, and prior art mobile patient lift taken along line 2—2 of FIG. 1.

FIG. 1 shows a bather 1, such as an invalid, being supported by a prior art mobile patient lift 2 in the sump 3 of the instant bathtub invention. The bathtub 4 is shown installed in an alcove formed by three walls 5, 6, 7 of a residential bathroom. The sink, commode, and other conventional features of a residential bathroom are not shown for clarity. The walls 5, 6, 7 may be structural load-bearing walls, non-structural partition type walls, or walls that do not extend the full floor-to-ceiling distance. Wall 7 is shown in cutaway view to expose the enclosed space 8 bounded by bathtub 4, walls 5, 6, 7 and the floor. As best shown in FIG. 2, the front wheels 10 and support legs 11 of the undercarriage of lift 2 extend through an opening 12 in the bathtub apron 13 and underneath the sump bottom 14. Optional opening closure 28 set on hinges 36 is shown in FIG. 2, but not in FIG. 1 for clarity.

With reference to both FIG. 1 and FIG. 2, bathtub 4 has a sump 3 defined by sump wall 15 and sump bottom 14. Adjacent the sump wall 15 is ledge 16. Apron 13 extends generally downwardly from the ledge 16 on the side or sides of the bathtub that face the interior of the room. The apron 13 has a floor edge 17 which is a surface of the apron adapted to rest upon a substantially horizontal support surface 9, such as the floor of the room in which the bathtub will be installed. Apron opening 12 is adjacent the substantially horizontal support surface 9 so that no portion of the apron 13 obstructs travel of the lift 2 through the opening 12. That is, no portion of the apron is between the opening and the substantially horizontal support surface 9. Removing a portion of the apron and the floor edge surface forms an opening in the apron. Smaller inner brace 18 and larger outer brace 19 connecting either or both lateral edges 20, 21 of the apron 13 to the ledge 16 may provide additional support, if desired. U.S. Pat. No. 5,129,804 to Perantoni et al., "Mold Having an Insert for Molding Bathtubs," describes an integral molded bathtub having such braces and a method of making a bathtub having these braces. The disclosure of the Perantoni patent is incorporated herein by reference.

The continuous sump wall 15 may be described as having a drain end wall 22, an opposite far end wall, and two opposing sump side walls 23, 24 which are generally longer than the end walls. The sump side walls 23, 24 and drain end wall 22 are generally substantially vertical. The far end wall is generally less steeply inclined in order to serve as a comfortable back rest or support. The drain end wall 22 preferably has an overflow opening 26. In the case of a whirlpool style bathtub, the sump wall 15 will have openings for air and/or water jets (not shown). The sump wall 15 may have indentations to form a soap ledge, grab hold, or similar structures (not shown). Means may be provided in the sump wall 15 or ledge 16, such as holes or small openings, for attachment of handles or other safety or convenience accessories (not shown).

Sump bottom 14 is defined as that portion of the sump that is substantially planar and substantially horizontal. By "substantially planar," I mean to allow for some modest degree of curvature across the width of the bathtub to facilitate drainage and allow for any slip-resistant surface relief characteristics, for example. By "substantially horizontal," I mean to allow for a reasonable drainage pitch in the longitudinal direction, as noted below. The sump bottom does not include, however, the transition zone 27 of substantial curvature between the sump wall and the sump bottom. This transition zone 27 between the substantially vertical side or drain end walls or the generally inclined far end sump wall and the sump bottom should be considered a part of the sump wall and does not fall with the scope of the "sump bottom."

Sump bottom 14 preferably surrounds drain opening 25. Most preferably, drain opening 25 is located close to sump wall 15 at one end of bathtub 4. Sump bottom 14 is generally slightly inclined away from drain opening 25 to facilitate drainage. Suitable sump bottom grades range from 1/16 in. or less to 1 in. or more change in height per foot, including about 1/8 in., about 1/4 in., and about 1/2 in. per foot. The wetted surface of sump bottom 14 may have small ridges, indentations, or other friction increasing features (not shown) to reduce the risk of a bather slipping and falling while in the bathtub.

Ledge 16 is preferably substantially horizontal so that the bather or his aide may conveniently and comfortably sit on the ledge if desired. Ledge 16, however, may also be substantially non-planar or otherwise curved and form a rim or lip at the periphery of the sump. The curvature of the ledge may be so sharp as to appear as a ridge between the steeply rising sump wall and the steeply falling apron. The width and shape of the ledge 16 may vary from one point to another. Preferably, ledge 16 extends around the entire periphery of the sump, but it may be present adjacent some sides of the sump and not others. The ledge may be provided with openings for accommodating faucet or other plumbing hardware (not shown).

The bathtub is made of integral construction. That is, the sump bottom 14, sump wall 15, ledge 16, and apron 13 together form a single piece and preferably shaped or otherwise formed during the same manufacturing step. The opening 12 and opening closure 28 may or may not have been shaped or formed during the same manufacturing step as the shaping or forming of the sump bottom, sump wall, ledge, and apron. Insofar as the opening closure 28 for the apron opening 12 is an optional and separable part of the bathtub, it is not to be considered a part of the integral bathtub.

Overflow opening 26 in sump wall 15 and drain opening 26 in sump bottom 14 are of conventional size and shape. Any tradesman having ordinary skill in installing bathtubs will know how to connect a drain to the drain opening 25 and overflow opening 26 even if these are spaced a greater distance from the floor than the conventional style integral bathtub.

Bathtub 4 can be any one of a wide variety of shapes. FIG. 1 shows a substantially rectangular bathtub adapted for installation in an alcove. Circular, ellipsoid, regular polygons, and irregular polygons are possible. The overall dimensions of length, width, other sides, or circumference are preferably of standard size, but virtually any desired dimensions are possible. Standard lengths for a substantially rectangular bathtub include about 54 in., 57 in., 60 in., and 72 in. The overall length of the invention can be any these standard lengths or a custom length, preferably between 54 in. and 72 in. Standard widths for a substantially rectangular bathtub are about 28 in. to about 48 in., including about 30 in. The overall width of the invention can be any of these standard widths or a custom width, preferably between 28 in. and 48 in. The overall height is generally the sum of the minimum sump bottom height D (defined below), the thickness of the sump bottom, and the desired sump depth. A standard sump depth is about 18½ in. to about 20½ in., but other sump depths are possible. Preferably, the sump depth is about 20½ in. to about 22½ in. to account for about 2 in. occupied by the lift's patient support 32 and still provide the desired patient immersion depth. In general, the fluid capacity of the sump and the length and width of the bathtub, or "footprint" in the case of an irregular shaped bathtub, are not substantially different than conventional prior art bathtubs. For the same immersion depth, however, the ledge of the instant invention will generally be higher than that of the conventional residential style bathtub.

As is conventional, the weight of the bathtub, bather, and water can be supported by shims placed underneath the sump bottom during installation of the bathtub. The skilled bathtub installer or carpenter will know how to provide the necessary support. For example, blocks of wood or other material resting on the floor can be built up underneath the sump bottom. Alternatively, support beams can be constructed underneath the sump bottom with shims placed between them and the sump bottom. It is not outside the scope of the invention to mold integral support ribs on the underside of the sump bottom similar to those shown by U.S. Pat. No. 5,341,527 to Schmidt et al., "Bathtub with Integrally Formed Leveling Base," the disclosure of which is incorporated herein by reference. Of course, the positioning of the ribs would be chosen so that they do not impede the proper positioning of the support legs 11 and front wheels 10 of the mobile patient lift 2 within the enclosed space 8. The same consideration must be made for the placement of the beams or shims. The beams, shims, and support ribs are not shown in any of the figures for clarity. Support block or rail 38, for supporting ledge 16, is securely attached to wall 6.

Figure 3:
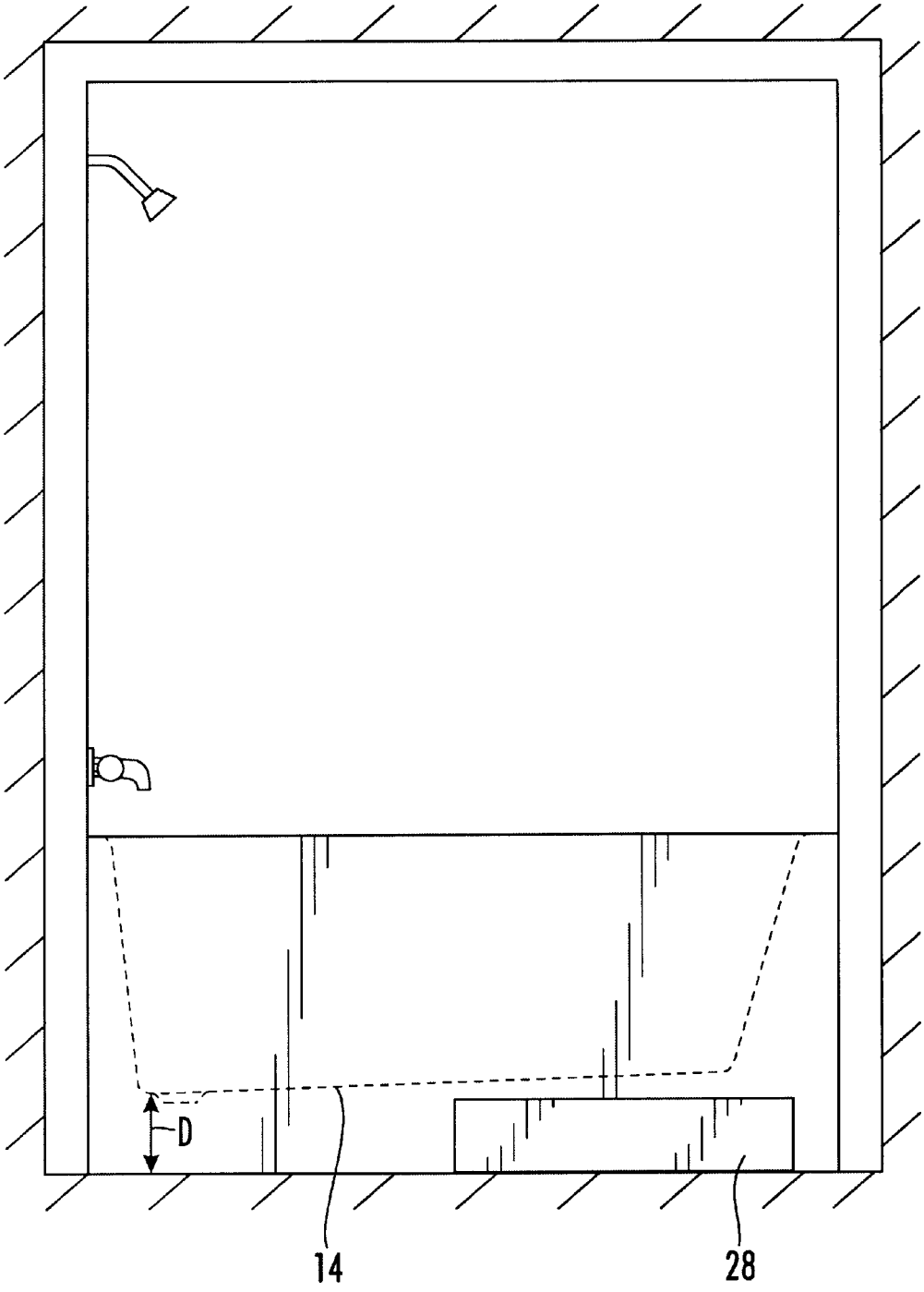
FIG. 3 is an elevation side view of a combination bathtub/shower unit of the present invention.

The term "sump bottom height" is defined as the vertical distance between a horizontal plane 39 passing through the apron floor edge 17 and the underside of the sump bottom 14, exclusive of support ribs, if any, drain opening lip, or other features projecting downwardly from the sump bottom. In most instances the underside of the sump bottom is the surface of the sump bottom within the enclosed space 8 that is otherwise substantially parallel to the wetted surface of the sump bottom. In most instances, the "horizontal plane 39 passing through the floor edge 17" will coincide with the substantially horizontal support surface 9, e.g., the floor. The term "sump bottom height" of a portion of the sump bottom refers to the height of that portion of the sump bottom, whereas "minimum sump bottom height," D, means the sump bottom height at the point where the sump bottom is vertically closest to the horizontal plane 39. In bathtubs having sump bottoms which are inclined slightly away from the drain opening, the minimum sump bottom height will generally be measured adjacent the drain opening of the sump bottom. This distance is indicated by the letter "D" on FIG. 2 and FIG. 3. The minimum sump bottom height therefore defines the maximum height of the portion of the mobile patient lift 2 that can be positioned at any point underneath the sump bottom, except for downwardly projecting features such as integral support ribs, if any.

The minimum sump bottom height D can be any value. Preferably, it falls within any range within the range 0–12 in. More preferably, the minimum sump bottom height is 1–10 inches. Even more preferably, the sump bottom height is 2–8 inches. Most preferably, the sump bottom height is 3–6 inches.

Figure 4:
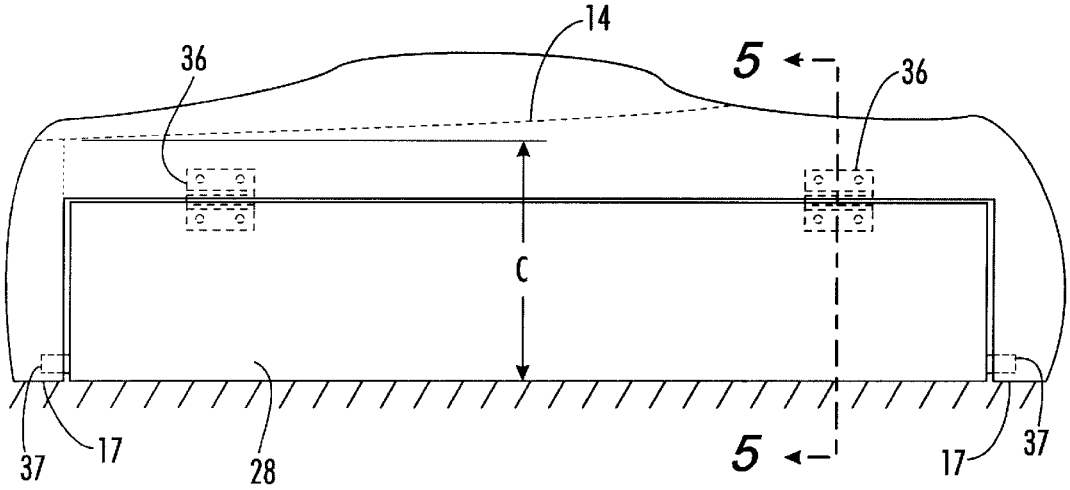
FIG. 4 is an elevation side view of a door closure covering the apron opening.
Figure 5:
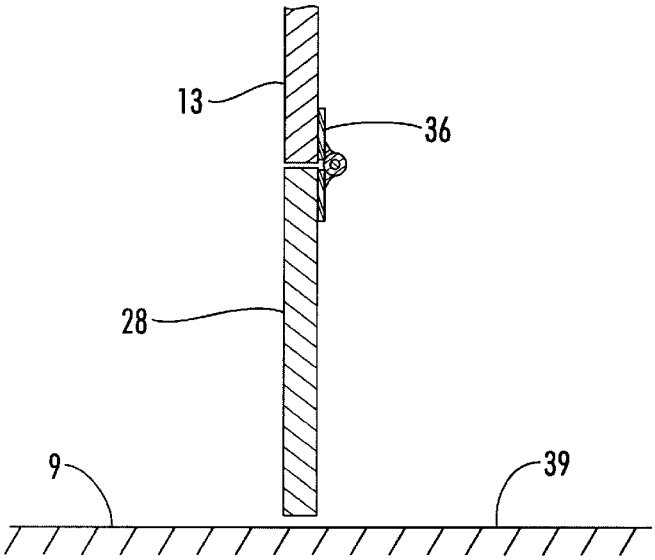
FIG. 5 is an elevation view of the apron, door closure, and hinge taken along line 5—5 of FIG. 4.

Insofar as the maximum height of the apron opening 12 above the horizontal plane 39 passing through the floor edge 17 may be the same, more, or less than the height of the sump bottom adjacent the opening, an expression for describing the elevation of this portion of the sump bottom above the horizontal plane 39 passing through the floor edge 17 is desirable. Accordingly, the expression "minimum sump bottom clearance" C, is defined as the height of that portion of the sump bottom adjacent the apron opening 12 that is closest the horizontal plane 39 passing through the apron floor edge 17. For the purpose of defining the minimum sump bottom clearance C, "adjacent" in general refers to the portion of the sump bottom 14 under which the lift undercarriage, e.g., support legs 11 and front wheels 10, may be located within the enclosed space 8. Specifically, for the purpose of defining the minimum sump bottom clearance C, "adjacent" refers to that portion of the sump bottom that is either within or above the projection of the apron opening 12 along a line generally perpendicular to the opening. For the purpose of defining this expression, the term "sump bottom" does not include support ribs or other downwardly projecting structures. In FIG. 4, the vertical dotted line aligned with the left edge of the apron opening 12 is drawn simply to show the point along the sump bottom 14 at which the clearance C is measured. If the sump bottom sloped down to the right, rather than to the left as in FIG. 4., the minimum sump bottom clearance C would be measured at a point aligned with the right edge of the apron opening 12. If the sump bottom 14 were closest to the floor at a point between the lateral edges of the opening, then the sump bottom clearance C would be measured at that point.

The bathtub of the present invention is adapted to be used in combination with a mobile patient lift 2 such as the Arjo lift 2 discussed above. Another mobile patient lift is shown in U.S. Pat. No. 5,343,575 to Cartwright et al. One such prior art mobile patient lift 2 is shown in FIG. 2. The lift 2 may be used in combination with the instant invention to raise, lower, support, and transport the patient using the bathtub. The lift shown includes front wheels 10, support legs 11, rear wheels 29, telescoping mast 30, lift mechanism 31, patient support 32, back support 33, and chest rest 34 (shown in FIG. 1). This style of mobile patient lift 2 may be described as a side-loading type lift since the patient is oriented with the lift mechanism 31 to the left or right side of the patient.

On this particular style of mobile patient lift, the support legs 11, front wheels 10, rear wheels 29, form what is referred to as the undercarriage of the lift. The undercarriage is that structure found generally close to the floor for supporting the mast or pillar and other operative parts of the lift. The undercarriage is also provided with means for mobilization, e.g., wheels, casters, and functional equivalents, of the entire lift apparatus.

The apron opening 12 allows a portion of the lift undercarriage, e.g., front wheels 10 and support legs 11, to pass beyond the apron 13 into the enclosed space 8. As best shown in FIG. 2, the spacing between the sump bottom 14 and the floor is sufficient to provide adequate clearance for positioning the front wheels 10 and a portion of the support legs 11 directly underneath the sump bottom 14. In use, each point along the uppermost surface of the support legs 11 rises a certain height above the floor on which wheels 10, 29 are supported. This height may be referred to as the "height-in-use" of that portion of the support legs. Dimension "D" is the minimum sump bottom height.

Preferably, apron opening 12, as shown in FIG. 1, is a single rectangular opening, but any shape capable of accomodating the desire patient lift 2 may be selected. For example, the opening may be a semi-circle, semi ellipse, a triangle, or virtually any other regular or irregular polygon or contour. The only requirement is that a portion of the desired lift 2 be capable of being positioned within the enclosed space 8 underneath the sump 3. Preferably, a portion of the desired lift 2 is capable of being positioned underneath the sump bottom 14 of the bathtub 4 so that the patient supported by the lift 2 can be positioned directly above the sump. For example, rather than a single rectangular opening, two smaller square or rectangular openings (not shown) may be provided with each one accommodating one of the two support legs and front wheels.

The preferred height and width of the apron opening 12 can be any size capable of enabling the desired lift 2 to be positioned close enough to the bathtub so than the patient can be positioned directly above the sump. Specifically, the maximum apron opening height, that is, the opening height at its highest point, is 1–8 in., preferably 2–7 in., more preferably 3–6 in., and most preferably 5–6 in. If a single opening is chosen to accommodate the portion of the lift entering the enclosed space, then the preferred opening width should be 28–36 in., more preferably 30–32 in. If two or more separate openings on the same side of the bathtub apron are used, one for each support leg, then each opening at its widest point can be 2–10 in. wide, preferably 4–8 in. wide, or most preferably about 6 in. wide. If two or more separate openings on the same side of the bathtub apron 13 are used, one for each support leg, then each opening at its greatest height can be 1–8 in., preferably 2–7 in., more preferably 3–6 in., and most preferably 5–6 in.

The apron 13 may be substantially planar or curved. In either case, the floor edge 17 is coplanar with a horizontal plane 39. Preferably, the floor is coincident with the horizontal plane 39 passing through the floor edge 17. The apron opening 12 can be positioned intermediate the lateral edges 20, 21 of the apron 13 in which case the opening splits the floor edge 17 into at least two distinct portions, as shown in FIG. 1. Alternatively, the apron opening 12 may extend as far as either one of the lateral edges 20, 21 of the apron 13.

The method of using the mobile patient lift 2 in combination with the bathtub invention will now be described. The patient in bed is rolled to one side. The lift mechanism 31 raises patient support 32 to the level of the mattress top surface. The lift 2 is then positioned adjacent the side of the patient's bed with the patient support 32 resting on the bed. The patient is then rolled onto the patient support 32 and bent at the waist into the sitting position. The telescoping mast 30 is alongside the patient's side rather than his back. Back support 33 and chest rest 34 are swung into place to prevent him from falling out of the lift 2. While being supported in the lift, the lift is moved away from the bed. Preferably, the patient support 32 is lowered to bring the patient's center of gravity closer to the ground to improve stability. The patient is then transported while supported by the mobile lift 2 to the vicinity of the bathtub 4. The patient support 32 is raised to a point where it clears the ledge 16 of the bathtub. The telescoping mast 30 is then brought closer to apron 13 by advancing front wheels 10 and a portion of support legs 11 through apron opening 12 to a point within enclosed space 8 and preferably underneath sump bottom 14. Lift mechanism 2 is used to lower the patient into sump 3 without the patient ever having to disembark the lift. Once the bath or whirlpool hydrotherapy is complete, the process is reversed and the patient is returned to his bed or other destination.

In FIG. 1, lift mechanism 31 of the side-loading type lift was to the left side of the patient. Accordingly, lift 2 approached the left side of the bathtub 4 so that the patient could face the drain. It will be apparent that the patient could have faced the opposite direction, if desired, either on the lift or in the sump.

Figure 6:
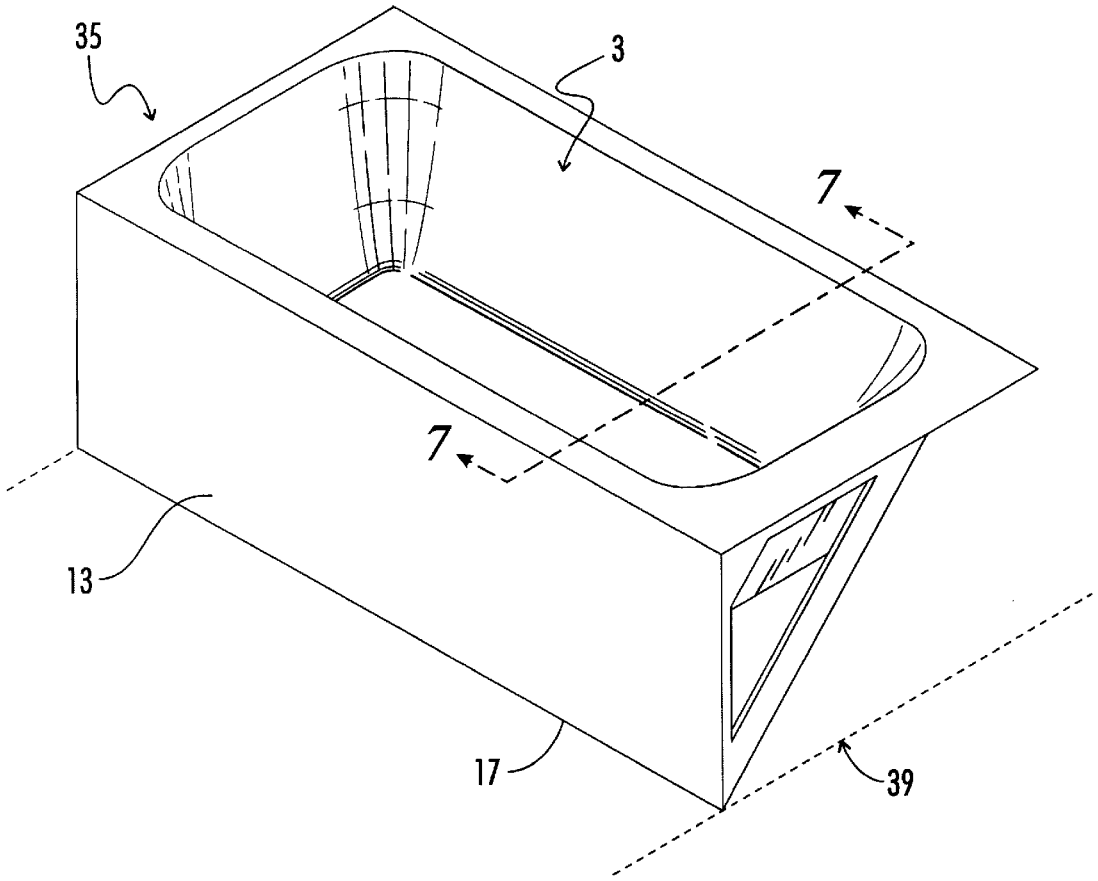
FIG. 6 is a perspective view of the second embodiment of the invention.
Figure 7:
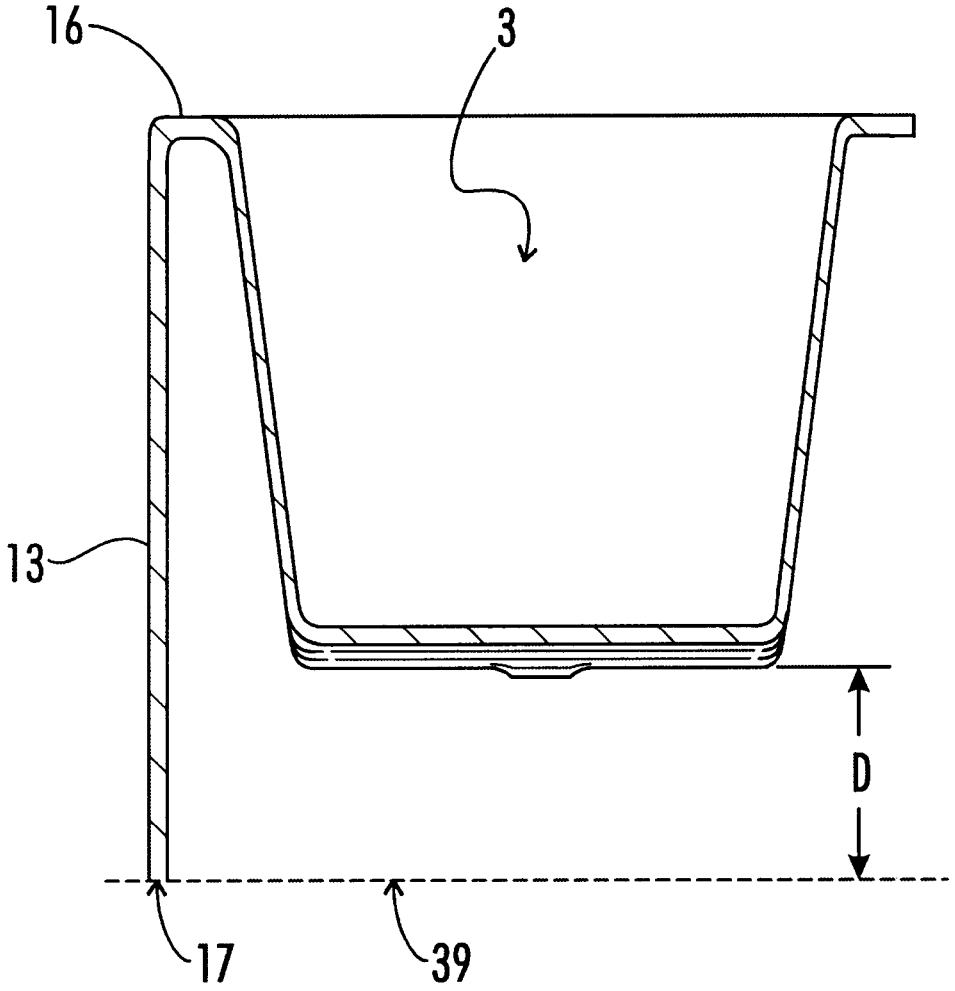
FIG. 7 is an elevation view of the second embodiment of the invention taken along line 7—7 of FIG. 6.

The first embodiment of the invention is the bathtub 4 described above having an apron opening 12. The second embodiment of the invention, bathtub 35, as shown in FIG. 6 and FIG. 7, does not include an apron opening 12. Second embodiment bathtub 35 is both an intermediate product in the method of manufacturing bathtub 4 (described below) as well as a final product in its own right. By design, like bathtub 4 of the first embodiment, sump bottom 14 of bathtub 35 is elevated a sufficient distance above the horizontal plane 39 passing through the floor edge 17 so that once an apron opening 12 is provided in bathtub 35, there is sufficient room under sump bottom 14 to accommodate the positioning of a portion of a patient lift 2 in the enclosed space and preferably underneath sump bottom 14. Whenever an apron opening 12 is required in the installed bathtub of the second embodiment, a portion of the apron 13 is cut out or otherwise removed from the apron 13 thereby simultaneously forming an apron opening 12 and opening closure 28. The bathtub 35 of the second embodiment, therefor, is intended for installation in new home construction or bathroom renovations for able-bodied persons who do not require (at the time of installation) an opening in the apron 13 to accommodate the positioning of a mobile patient lift 2 under sump 3. If such a need arises, second embodiment bathtub 35 is especially adapted for conversion to a first embodiment bathtub 4 having an apron opening 12. The conversion is accomplished by cutting an apron opening 12 in the apron 13 adjacent the floor with a tool suitable for the material of construction from which bathtub 35 was made. Because bathtub 35 was manufactured having a minimum sump bottom height D adequate to accommodate the positioning of a portion of the undercarriage, e.g., the support legs 11 and front wheels 10, of a suitable mobile patient lift 2, it is not necessary to replace second embodiment bathtub 35 with a first embodiment bathtub 4. Once the apron opening 12 is formed, the portion of the apron 13 that was removed may be attached to the apron 13 as described below to form an opening closure 28. During the process of installing second embodiment bathtub 35, shims or support beams may be installed only in places where one would not expect the undercarriage of the lift 2 to be positioned. Alternatively, shims or support beams may be placed at any convenient location and removed or repositioned as needed only after the apron opening 12 is provided after initial installation of the second embodiment bathtub 35.

First and second embodiment bathtubs 4, 35 may be made from a wide variety of materials suitable for forming integral bathtubs. These materials include those from which conventional residential bathtubs and whirlpools of integral construction are currently molded or otherwise formed. Among these single or multi-layered materials are acrylic-coated fiberglass-reinforced polyester, gel-coated fiberglass-reinforced polyester, plastic-backed enameled steel, enameled steel, enameled cast iron, marble, composites, reinforced plastic, and other materials that the person of skill in this art will recognize as being suitable for forming molded and non-molded integral bathtubs, whirlpools, and other types of sanitary fixtures.

As is conventional in residential style bathtubs, bathtubs 4, 35 can be manufactured in a wide variety of colors to produce a stylish and aesthetically pleasing bathroom sanitary fixture.

A variety of manufacturing methods are known for forming integral molded and non-molded bathtubs. Some methods are described in U.S. Pat. No. 5,338,501 to Marsilio, the disclosure of which is incorporated herein by reference. The Marsilio technique begins with a bathtub shell preferably constructed from a stamped sheet of steel which has been coated with an enamel on either its finish side alone, or on it finish and non-finish sides, as disclosed in U.S. Pat. No. 4,664,982 to Genovese et al., the disclosure of which is also incorporated herein by reference. It has a finished interior side and a non-finished exterior. The finished side is ordinarily viewed after installation and contacted by the user. The non-finish side is not ordinarily exposed to view after installation. Alternatively, the shell can be constructed from polymeric glass fibers, such as fiberglass and/or the composite materials disclosed in U.S. Pat. Nos. 4,844,944 and 4,844,955 to Graefe et al. and U.S. Pat. No. 5,129,804 to Perantoni et al. The bathtub shell is then placed in a mold. Polymeric material is injected into the mold to form a polymeric layer on the non-finish side of the shell. The polymeric material and suitable primers are described in U.S. Pat. Nos. 4,664,982, 4,844,944, 4,844,955, and 5,129,804. The bathtub may be made using a polymeric material molded to the non-finish side of a bathtub shell, as described for example in U.S. Pat. No. 5,338,501 to Marsilio. Alternative fabrication techniques include the RIM and RRIM processes described in U.S. Pat. No. 4,844,944 to Graefe et al.

Any of these and other methods are generally applicable for making the bathtubs of the instant invention with the following additional remarks. By whatever means the bathtub is formed, it must acquire a shape which provides adequate clearance between the sump bottom 14 and the horizontal plane 39 passing through the floor edge 17 to accommodate the undercarriage of whichever model or style of mobile patient lift is desired. The bathtub mold and stamped metal sheet, if any, must be appropriately shaped to produce the bathtubs 4, 35 having the desired geometrical relationships of overall shape and dimension, minimum sump bottom height, minimum sump bottom clearance, sump bottom drainage grade, and support ribs, if any, etc. The apron opening 12 of the first embodiment bathtub 4 can be made during the molding step by a mold having the proper shape or having a mold insert which occupies the area that will become the apron opening 12. In that case, the apron closure 28, if any, can be made by a separate molding step or in a different part of the same mold. Preferably, in making both the first and second embodiment bathtubs 4, 35, the opening closure 28 is initially formed as an integral part of the apron 13. After the molding step, either before or after any coating or finishing steps, the first embodiment bathtub 4 is made by cutting out or otherwise removing the opening closure 28 from the apron 13 to form the apron opening 12 before installation of the bathtub 4. This step is omitted in making the second embodiment bathtub 35. In the case of the second embodiment bathtub 35, neither the apron opening 12 nor the optional opening closure 28 is formed, if at all, until after the bathtub 35 has been installed.

The opening closure 28 may be attached to the inside surface of the apron 13 using any convenient fastening device, such as hinge 36. In FIG. 2, the door 28 is held in the upright position by a two-position spring biased hinge, but alternative designs for the closure 28 are possible. For example, the hinge 36 may be an ordinary hinge without a spring mechanism. In that case, gravity would return the door 28 to its closed position. Alternatively, the closure 28 is not a door permanently attached to the apron 13, but instead is a panel placed in the opening 12 when not in use. The panel may have tabs 37 at its sides which cooperate via magnet or hook and loop type fasteners, e.g., VELCRO® brand hook and loop fasteners, to provide removable attachment of the panel style opening closure 28 to the apron 13. The tabs are separate parts attached to the backside of the closure 28, i.e., the side facing the enclosed space 8, if the closure was integrally formed with the apron and removed therefrom either before or after installation of the bathtub. If the closure 28 was separately formed or molded apart from the apron, then the tabs may have been integrally formed with the closure.

The configuration of bathtub 4 shown in FIG. 1 is that of an alcove style bathtub. As shown in FIG. 1, the alcove is defined by three walls forming the bathroom. An alternative type of alcove is one defined by two adjacent walls and a partition. Of course, alternative bathtub configurations are envisioned. For example, the bathtub could be installed in a corner of a room defined by only two perpendicular walls. In such a corner installation, the apron 13 would extend around the bathtub's corner facing the interior of the room and cover the far end of the bathtub. While the apron opening 12 would preferably be positioned on the longer side of the bathtub, an alternate or additional opening 12 could be positioned adjacent the floor on the far end portion of the apron 13. Such an apron opening 12 on the far end of the bathtub would accommodate a patient with his back to the lift mast 30 of a front-loading type lift (not shown).

Another possible bathtub configuration positions the bathtub against only one wall with the bathtub extending into the interior of the room. In this case, the apron 13 extends around all three sides that are not against the wall. Apron openings 12 could be positioned on any one, two, or all three sides facing the room interior. Yet another bathtub configuration has the apron 13 only on both longer sides of the bathtub. The bathtub would be installed with the drain end against one wall and the far end opposite the drain end against another wall, perhaps a free-standing wall. Such a configuration would permit access to the sump 3 from either the right ledge or left ledge. Either or both aprons could be provided with apron openings 12. Finally, a free standing bathtub configuration is also possible. That is, the bathtub has an apron 13 which extends abound the entire periphery of the sump 3. The bathtub would not be positioned against any wall. Apron openings 12 could be provided on any desired side.

Although the bathtub has been described as being particularly suitable for use by invalids or similarly physically incapacitated or handicapped persons, it will be apparent that perfectly able-bodied persons can use the bathtub as well. Animals and inanimate objects can be placed in the lift and used with the instant invention, too. Unlike other types of bathing systems designed for use by invalids and the like in a hospital or institutional setting, both the first and second embodiments of the bathtub of the instant invention resemble a conventional integral molded or non-molded residential style bathtub supported by the floor. Such residential style bathtubs can be found in the bathrooms of a wide variety of private homes. The chief difference between the prior art residential bathrooms and the invention is the provision of adequate floor-to-sump bottom clearance and the optional apron opening 12 to accommodate mobile patient lifts. If used by an able-bodied person, the bathtub of the present invention could be used in the ordinary manner without resorting to the apron opening 12, its optional closure 28, or mobile patient lift.

While I have described what are presently contemplated as being the preferred embodiments of the present invention, further changes and modifications could be made by those skilled in the art without departing from the scope of the invention, and it is contemplated to claim all such changes and modifications. For example, the apron needn't be integrally formed with the sump wall, sump bottom, and ledge.

I claim:

1. A sanitary fixture for the at least partial immersion of a person, animal, or inanimate object in a cleansing fluid contained therein and for use with a mobile patient lift having an undercarriage including a first undercarriage portion characterized by a height-in-use, said sanitary fixture comprising:

a sump comprising synthetic plastic for containing said cleansing fluid, said sump being formed by a sump bottom and a sump wall, with a portion of said sump bottom being characterized by a sump bottom height;

a ledge connected to said sump; and an apron extending downwardly from said ledge and terminating in a floor edge surface adapted to contact and be supported by a substantially horizontal support surface, said floor edge surface being at an elevation lower than said portion of said sump bottom, wherein said sump bottom, sump wall, and ledge are integrally formed and said sump bottom height is larger than said height-in-use whereby said sanitary fixture is adapted to receive said first undercarriage portion beneath said portion of said sump bottom.

2. The sanitary fixture of claim 1 wherein the sanitary fixture is a bathtub or whirlpool.

3. The sanitary fixture of claim 1 wherein the sump is made from materials selected from the group consisting of acrylic-coated fiberglass-reinforced polyester, gel-coated fiberglass-reinforced polyester, plastic-backed enameled steel, composite, and reinforced plastic.

4. The sanitary fixture of claim 1 wherein the sump bottom, sump wall, ledge, and apron are integrally formed.

5. The sanitary fixture of claim 1 wherein said undercarriage supports a lift mast and said first undercarriage portion is a substantial portion of the undercarriage to one side of said lift mast.

6. The sanitary fixture of claim 1 wherein the sump bottom height is at least 2 in.

7. The sanitary fixture of claim 6 wherein the sump bottom height is at least 4 in.

8. The sanitary fixture of claim 7 wherein the sump bottom height is at least 6 in.

9. The sanitary fixture of claim 1 further comprising an opening in said apron adjacent said floor edge surface, said opening being large enough for said first undercarriage portion of the mobile patient lift to pass therethrough.

10. The sanitary fixture of claim 9 wherein said opening is large enough so that in use, a second portion of said undercarriage may be positioned directly below said sump bottom so that a patient supported by said mobile patient lift may be positioned directly above said sump.

11. The sanitary fixture of claim 9 further comprising closure means for closing said opening.

12. The sanitary fixture of claim 11 wherein said closure means is substantially identically composed as said apron.

13. A method of making a sanitary fixture having a sump bottom, sump wall, ledge, and apron comprising the steps of:

integrally forming said sump bottom, sump wall, ledge, and apron, said apron extending downwardly from said ledge to a floor edge surface located at an elevation below the elevation of at least a portion of said sump bottom, said floor edge surface adapted to be supported in use by a substantially horizontal support surface; and removing a portion of said apron and said floor edge surface thereby forming an opening in said apron.

14. The method of claim 13 further comprising the step of attaching said portion removed from said apron to said apron so that the opening can be opened and closed by said portion.

15. A method of using a mobile patient lift having an undercarriage to position a portion of a human, animal, or inanimate object within a sump of a sanitary fixture, said fixture having a sump bottom and a downwardly extending apron supported by a substantially horizontal support surface, said method comprising:

supporting said human, animal, or inanimate object by said lift;

moving a portion of said lift through an opening in said apron; and positioning said portion of said human, animal, or inanimate object in said sump.

16. The method claim 15 wherein a portion of the undercarriage is positioned underneath the sump bottom.

17. The method of claim 16 including the step of moving closure means attached to said apron in order to open said opening.

18. A method of modifying an installed sanitary fixture having a sump, a downwardly extending apron terminating in a floor edge surface supported by a substantially horizontal support surface, and a sump bottom, wherein a portion of said sump bottom is at a higher elevation than the support surface, the method comprising the steps of:

removing a portion of the apron to form an opening in said apron; and optionally attaching the removed portion to the apron so that the opening can be closed and opened.

19. The method of claim 18 wherein said opening is large enough so that a portion of an undercarriage of a mobile patient lift can pass through the opening.

20. The method of claim 19 wherein said opening and a sump bottom height of said portion of the sump bottom are large enough so that another portion of the undercarriage of the mobile patient lift can be positioned beneath the sump bottom and a person, animal, or inanimate object supported by the lift may be positioned directly above the sump.

* * * * *